US007416444B1

(12) United States Patent
Lin

(10) Patent No.: US 7,416,444 B1
(45) Date of Patent: Aug. 26, 2008

(54) COAXIAL CONNECTOR WITH TWO DIFFERENT OUTPUTS

(75) Inventor: Tien-Hsing Lin, Yong-Kang (TW)

(73) Assignee: Hantechnic Incorporated, Tainan Hsien (TW)

( * ) Notice: Subject to any disclaimer, the term of this patent is extended or adjusted under 35 U.S.C. 154(b) by 0 days.

(21) Appl. No.: 11/766,230

(22) Filed: Jun. 21, 2007

(51) Int. Cl.
*H01R 9/05* (2006.01)

(52) U.S. Cl. ..... 439/578; 439/188; 200/51.1

(58) Field of Classification Search ..... 439/578, 439/188; 200/51.1
See application file for complete search history.

(56) References Cited

U.S. PATENT DOCUMENTS 5,562,464 A * 10/1996 Lecourtois ..... 439/188
6,572,405 B2 * 6/2003 Lin et al. ..... 439/578
6,872,091 B2 * 3/2005 Huang ..... 439/578
7,168,980 B2 * 1/2007 Peng ..... 439/580

* cited by examiner

*Primary Examiner*—Renee S Luebke
*Assistant Examiner*—Vanessa Girardi
(74) *Attorney, Agent, or Firm*—Ladas & Parry LLP

(57) ABSTRACT

An electrical connector includes a first terminal fixed on a tubular housing and extending radially into the housing, a second terminal fixed in the housing and having an annular flange, and a conductive ring sleeved movably on the second terminal. The conductive ring has a curved inner annular abutting face. A biasing member biases the conductive ring to move toward the annular flange such that the annular flange comes into electrical contact with the inner annular abutting face of the conductive ring and that the conductive ring contacts electrically the first terminal. The conductive ring is pushed by an actuating sleeve sleeved movably on the second terminal to move away from the first terminal.

4 Claims, 6 Drawing Sheets

COAXIAL CONNECTOR WITH TWO DIFFERENT OUTPUTS

BACKGROUND OF THE INVENTION

1. Field of the Invention

The invention relates to an electrical connector, more particularly to an electrical connector capable of being switched between two states.

2. Description of the Related Art

FIGS. 1 and 2 illustrate a conventional electrical connector 1 disclosed in U.S. Pat. No. 6,547,592. The conventional electrical connector 1 includes a tubular housing 11, a first terminal 14 fixed on and extending radially into the housing 11, an insulating elastic member 12 anchored in the housing 11, a second terminal 13 disposed in the housing 11 and extending in an axial direction (X') through the elastic member 12, a conductive sleeve 15 sleeved movably on and contacting electrically the second terminal 13, and an insulating actuating sleeve 16 sleeved movably on the second terminal 13.

The conventional electrical connector 1 is normally operated in a first state, where the conductive sleeve 15 contacts electrically the first terminal 14 such that the first terminal 14 is connected electrically to the second terminal 13 via the conductive sleeve 15. When an external terminal 100 is inserted into the housing 11 so as to be coupled electrically to a female end portion of the second terminal 13, the actuating sleeve 16 is pushed by the external terminal 100 to move toward the conductive sleeve 15. Hence, the conductive sleeve 15 is pushed by the actuating sleeve 16 to move away from the first terminal 14 and to compress the elastic member 12. As a result, the conventional electrical connector 1 comes into a second state, where the external terminal 100 is connected electrically to the second terminal 13, as shown in FIG. 2.

In such a configuration, when the conventional electrical connector 1 is switched from the second state to the first state, i.e., the external terminal 100 is removed from the housing 11, the conductive sleeve 15 is pushed by the elastic member 12 due to the restoration force thereof to move toward the first terminal 14 until the conductive sleeve 15 contacts electrically the first terminal 14. It is noted that, during movement of the conductive sleeve 15 toward the first terminal 14, since a part of the conductive sleeve 15 is stopped by the first terminal 14, inertia of the conductive sleeve 15 results in deviation of the conductive sleeve 15 from the axial direction (X'), as shown in FIG. 1. As a result, an annular outer surface of the second terminal 13 is easily scratched by the conductive sleeve 15, thereby affecting adversely high-frequency signal transmission of the second terminal 13 and electrical contact between the conductive sleeve 15 and the first terminal 14 after a period of use.

SUMMARY OF THE INVENTION

Therefore, the object of the present invention is to provide an electrical connector that can overcome the aforesaid drawbacks of the prior art.

According to the present invention, an electrical connector comprises:

a tubular housing having first and second open ends opposite to each other in an axial direction and formed with a through hole;

an insulating first terminal-mounting seat mounted fixedly in the through hole in the housing;

a first terminal fixed to the first terminal-mounting seat and extending in a radial direction through the first terminal-mounting seat and into the housing;

an insulating second terminal-mounting seat disposed fixedly in the housing and disposed adjacent to the first open end of the housing;

a second terminal disposed in the housing, fixed to the second terminal-mounting seat, and extending in the axial direction through the second terminal-mounting seat, the second terminal having a radially and outwardly extending annular flange that is spaced apart from the second terminal-mounting seat and that is disposed adjacent to the first terminal;

a conductive ring sleeved movably on the second terminal, and having a first ring section disposed between the second terminal-mounting seat and the annular flange of the second terminal and having an inner diameter smaller than an outer diameter of the annular flange of the second terminal, and a second ring section connected integrally to the first ring section and having an inner diameter slightly larger than the outer diameter of the annular flange of the second terminal, the conductive ring having a curved inner annular abutting face disposed at a junction of the first and second ring sections;

a biasing member disposed between the second terminal-mounting seat and the conductive ring for biasing the conductive ring to move toward the annular flange of the second terminal such that the annular flange comes into electrical contact with the inner annular abutting face of the conductive ring and that the second ring section of said conductive ring contacts electrically the first terminal; and an actuating sleeve sleeved movably on the second terminal, disposed between the conductive ring and the second open end of the housing, and operable so as to move toward the first open end of the housing such that the conductive ring is pushed by the actuating sleeve to move away from the first terminal.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
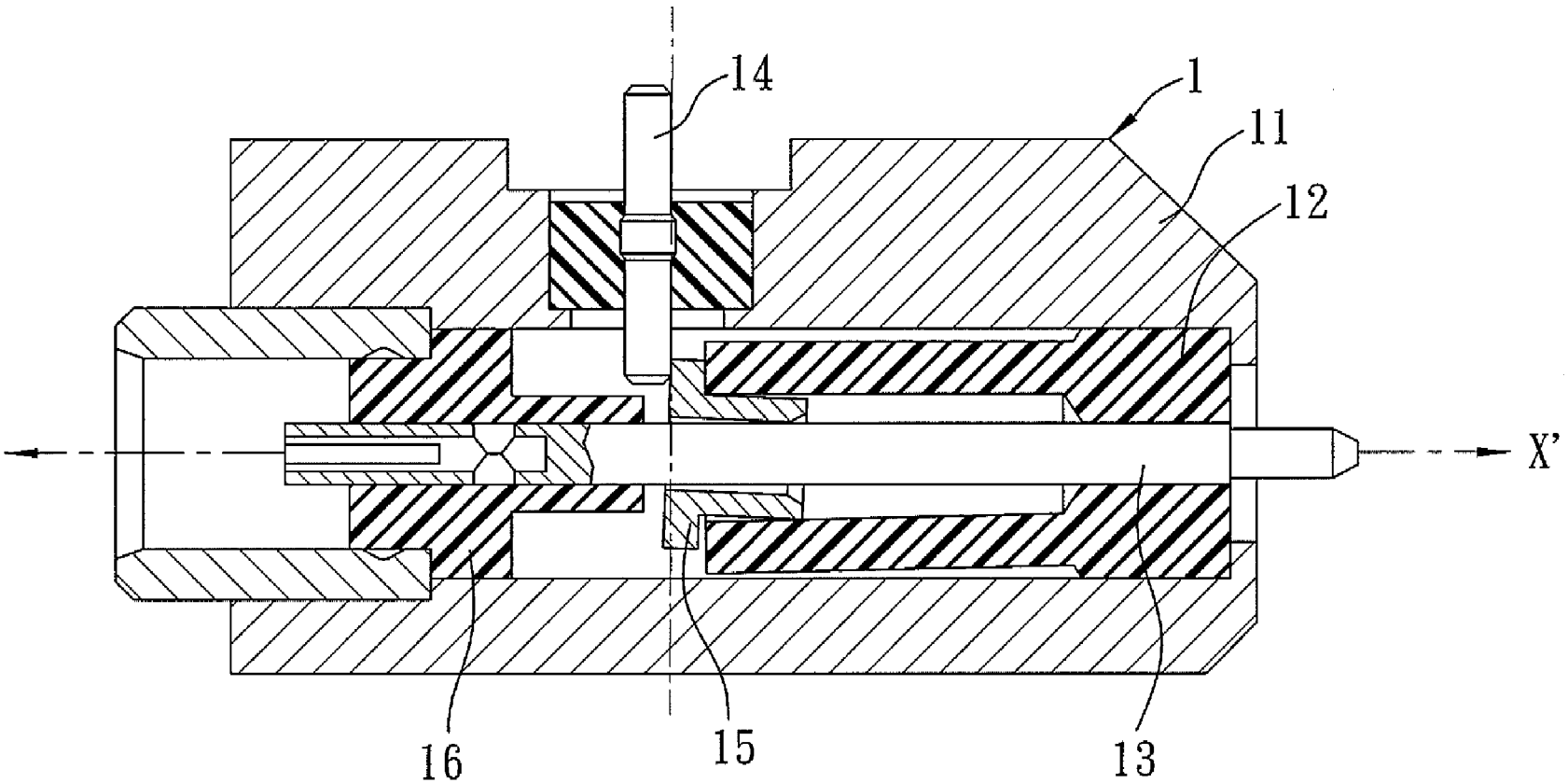
FIG. 1 PRIOR ART
FIG. 1 is a schematic partly sectional view of a conventional electrical connector when in a state of use.
Figure 2:
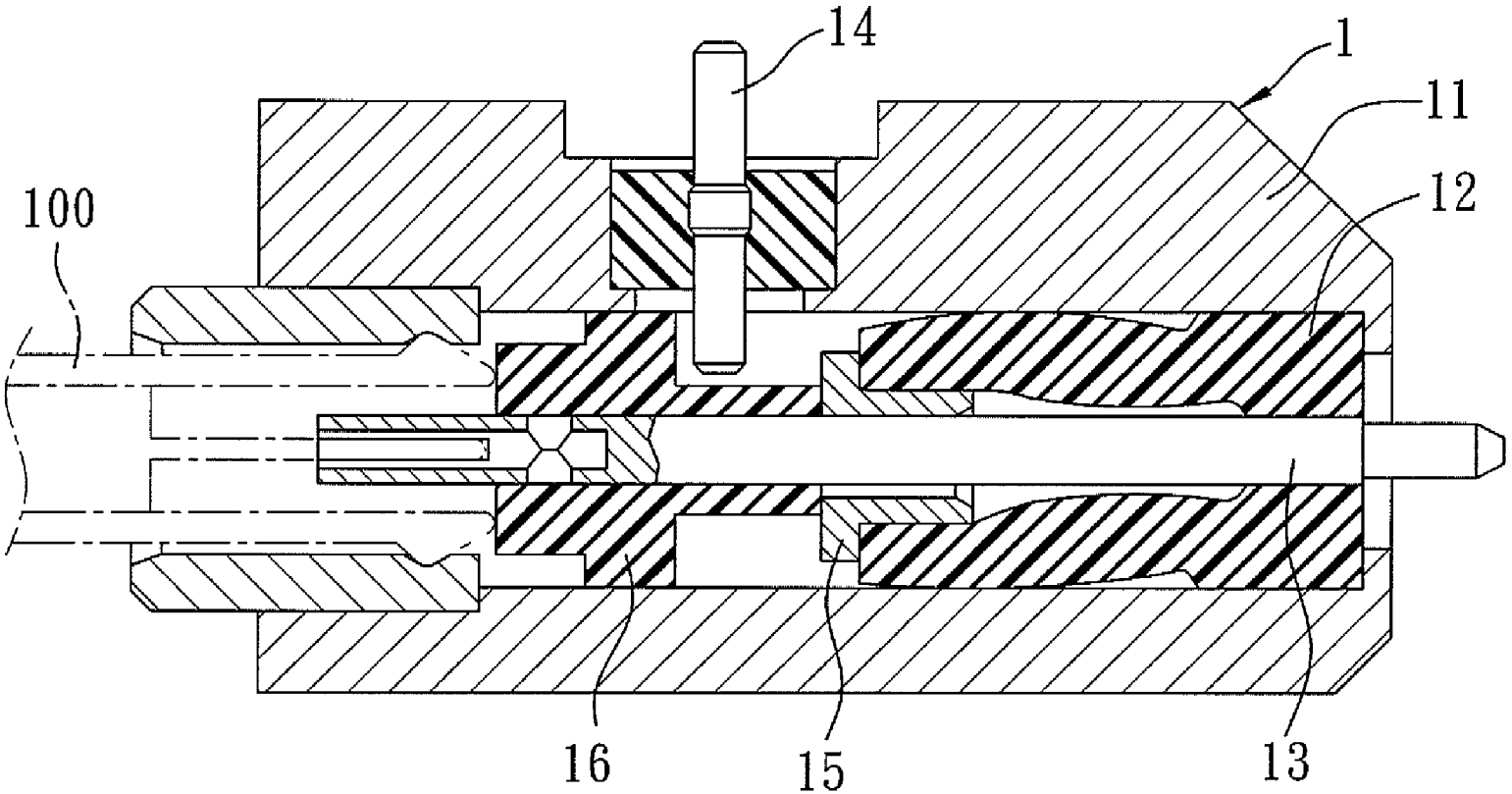
FIG. 2 PRIOR ART
FIG. 2 is a schematic partly sectional view of the conventional electrical connector when in another state of use.
Figure 3:
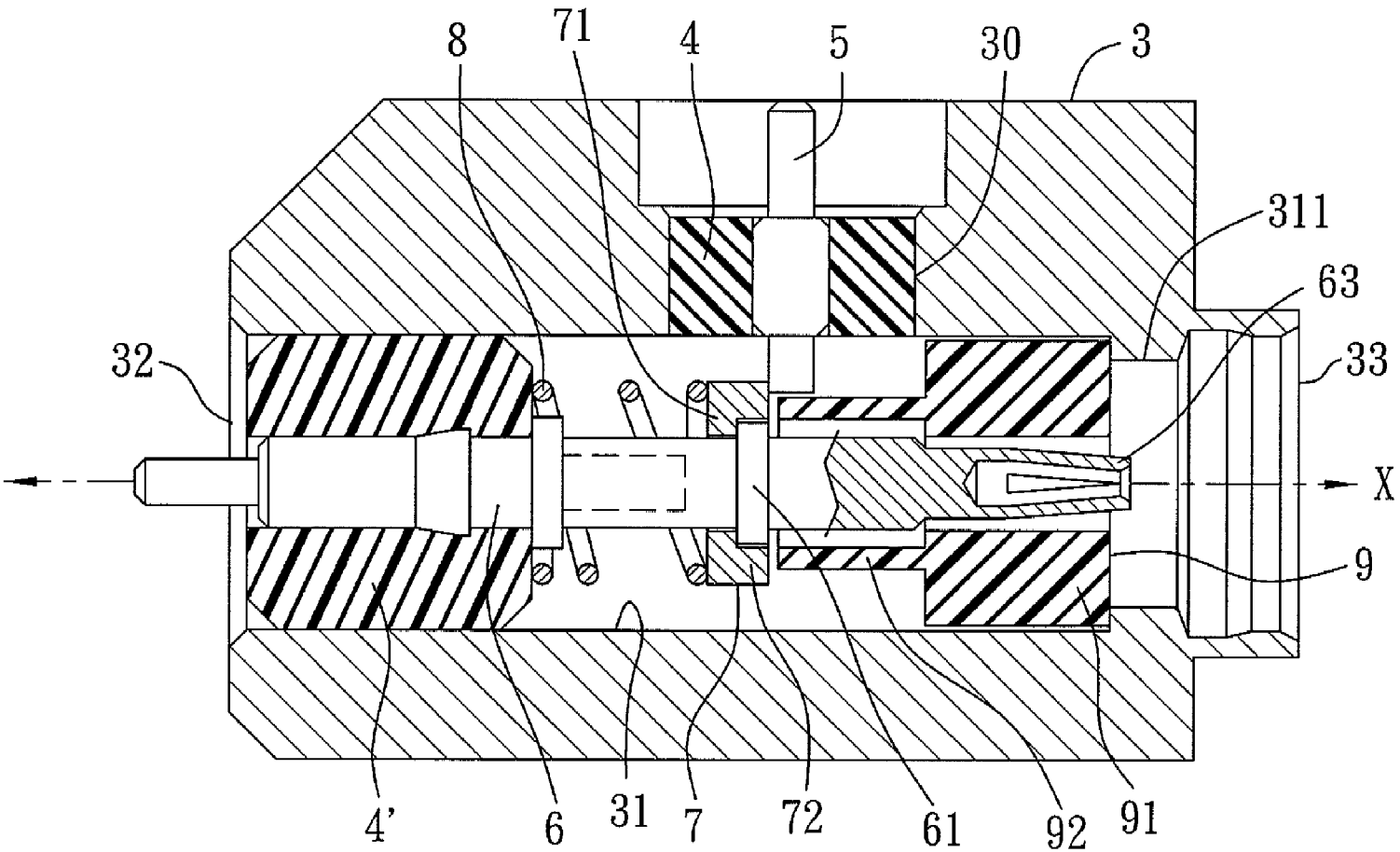
FIG. 3 is a schematic partly sectional view showing the preferred embodiment of an electrical connector according to the present invention when in a first state of use.
Figure 4:
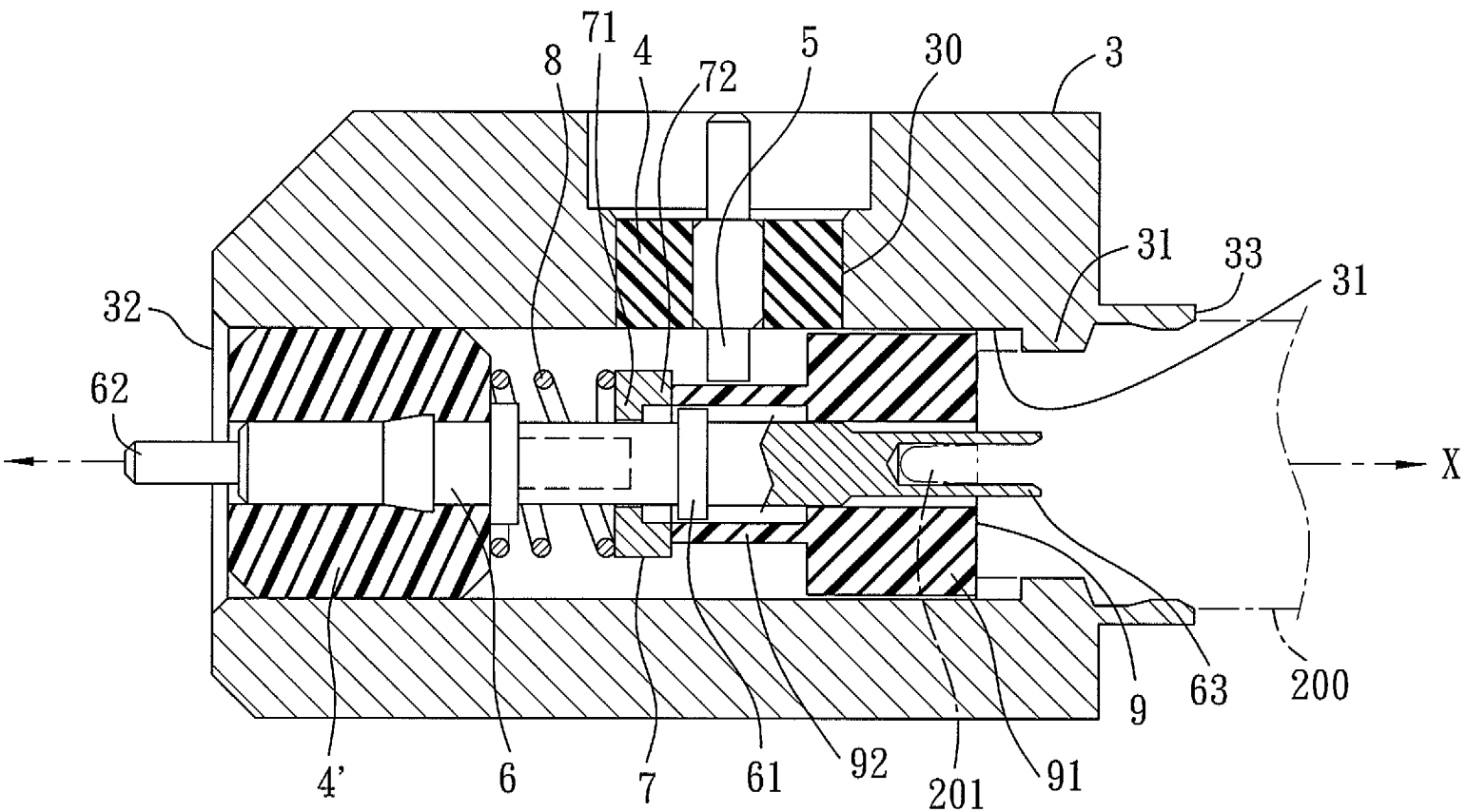
FIG. 4 is a schematic partly sectional view showing the preferred embodiment when in a second state.

Referring to FIGS. 3 and 4, the preferred embodiment of an electrical connector according to the present invention is shown to be adapted for insertion of an external terminal 200 (FIG. 4) thereinto, and includes a tubular housing 3, an insulating first terminal-mounting seat 4, a first terminal 5, an insulating second terminal-mounting seat 4', a second terminal 6, a conductive ring 7, a biasing member 8, and an actuating sleeve 9.

The tubular housing 3 has first and second open ends 32, 33 opposite to each other in an axial direction (X), and is formed with a through hole 30. In this embodiment, the tubular housing 3 has an inner annular surface 31 formed with a radially extending annular position-limiting flange 311.

The first terminal-mounting seat 4 is made of an insulating material, and is mounted fixedly in the through hole 30 in the housing 3.

In this embodiment, the first terminal 5 is in the form of a rod, and is made of beryllium copper. The first terminal 5 is fixed to the first terminal-mounting seat 4, and extends in a radial direction through the first terminal-mounting seat 4 and into the housing 3. The second terminal-mounting seat 4' is disposed fixedly in the housing 3, and is disposed adjacent to the first open end 32 of the housing 3.

In this embodiment, the second terminal 6 is in the form of a rod, and is made of beryllium copper. The second terminal 6 is disposed in the housing 3, is fixed to the second terminal-mounting seat 4', and extends in the axial direction (X) through the second terminal-mounting seat 4'. In this embodiment, the second terminal 6 has a male end portion 62 extending outwardly of the first open end 32 of the housing 3, and a female end portion 63 opposite to the male end portion 61 and disposed adjacent to the second open end 33 of the housing 3. The female end portion 63 of the second terminal 6 is adapted to be coupled electrically to a male end portion 201 of the external terminal 200 when the external terminal 200 is inserted into the housing 3 via the second open end 33, as shown in FIG. 4. The second terminal 6 further has a radially and outwardly extending annular flange 61 that is spaced apart from the second terminal-mounting seat 4' and that is disposed adjacent to the first terminal 5.

Figure 5:
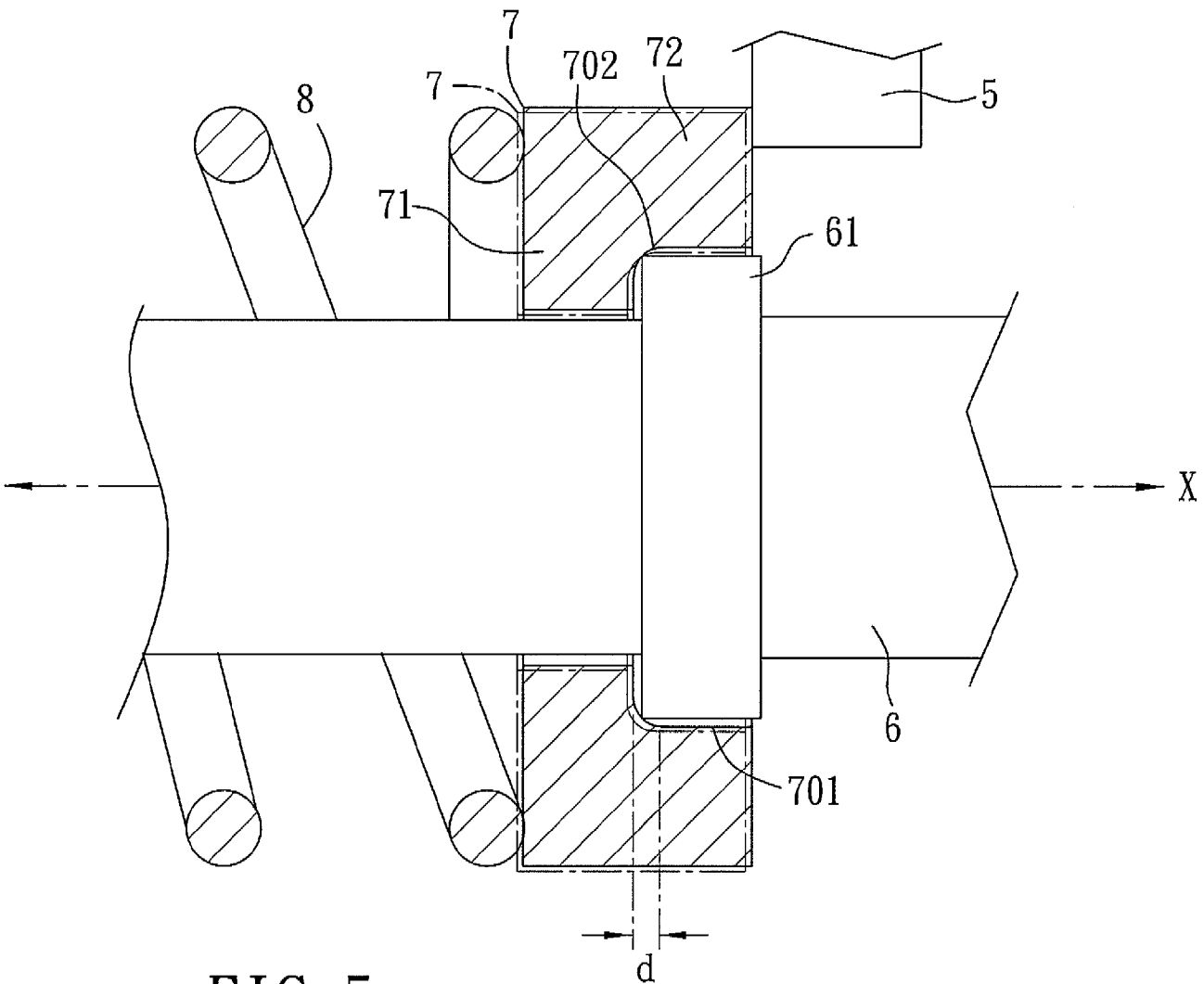
FIG. 5 is an enlarged fragmentary, partly schematic sectional view showing the preferred embodiment when in the first state of use.

The conductive ring 7 is made of beryllium copper, and is sleeved movably on the second terminal 6. The conductive ring 7 has a first ring section 71 disposed between the second terminal-mounting seat 4' and the annular flange 61 of the second terminal 6 and having an inner diameter smaller than an outer diameter of the annular flange 61 of the second terminal 6, and a second ring section 72 connected integrally to the first ring section 71 and having an inner diameter slightly larger than the outer diameter of the annular flange 61 of the second terminal 6. It is noted that the conductive ring 7 has a curved inner annular abutting face 702 disposed at a junction of the first and second ring sections 71, 72 and having an axial length (d) of about 0.05 mm, as best shown in FIG. 5.

The biasing member 8 is disposed between the second terminal-mounting seat 4' and the conductive ring 7 for biasing the conductive ring 7 to move toward the annular flange 61 of the second terminal 6 such that the annular flange 61 comes into electrical contact with the inner annular abutting face 702 of the conductive ring 7 and that the second ring section 72 of the conductive ring 7 contacts electrically the first terminal 5, as shown in FIG. 3. In this embodiment, the biasing member 8 is a coil spring that is sleeved on the second terminal 6 and that has opposite ends abutting respectively against the second terminal-mounting seat 4' and the first ring section 71 of the conductive ring 7.

The actuating sleeve 9 is made of an insulating material, is sleeved movably on the second terminal 6, and is disposed between the conductive ring 7 and the second open end 33 of the housing 3. The actuating sleeve 9 is operable so as to move toward the first open end 32 of the housing 3 such that the conductive ring 7 is pushed by the actuating sleeve 9 to move away from the first terminal 5, as shown in FIG. 4. In this embodiment, the actuating sleeve 9 has a first sleeve portion 91 disposed adjacent to the second open end 33 of the housing 3 and sleeved movably on the second terminal 6, and a second sleeve portion 92 connected integrally to the first sleeve portion 91 and extending toward the conductive ring 7. The second sleeve portion 92 of the actuating sleeve 9 is coaxial with the annular flange 61 of the second terminal 6, has an inner diameter larger than the outer diameter of the annular flange 61 of the second terminal 6, and comes into contact with the second ring section 72 of the conductive ring 7 when the actuating sleeve 9 moves toward the first open end 32 of the housing 3.

Figure 6:
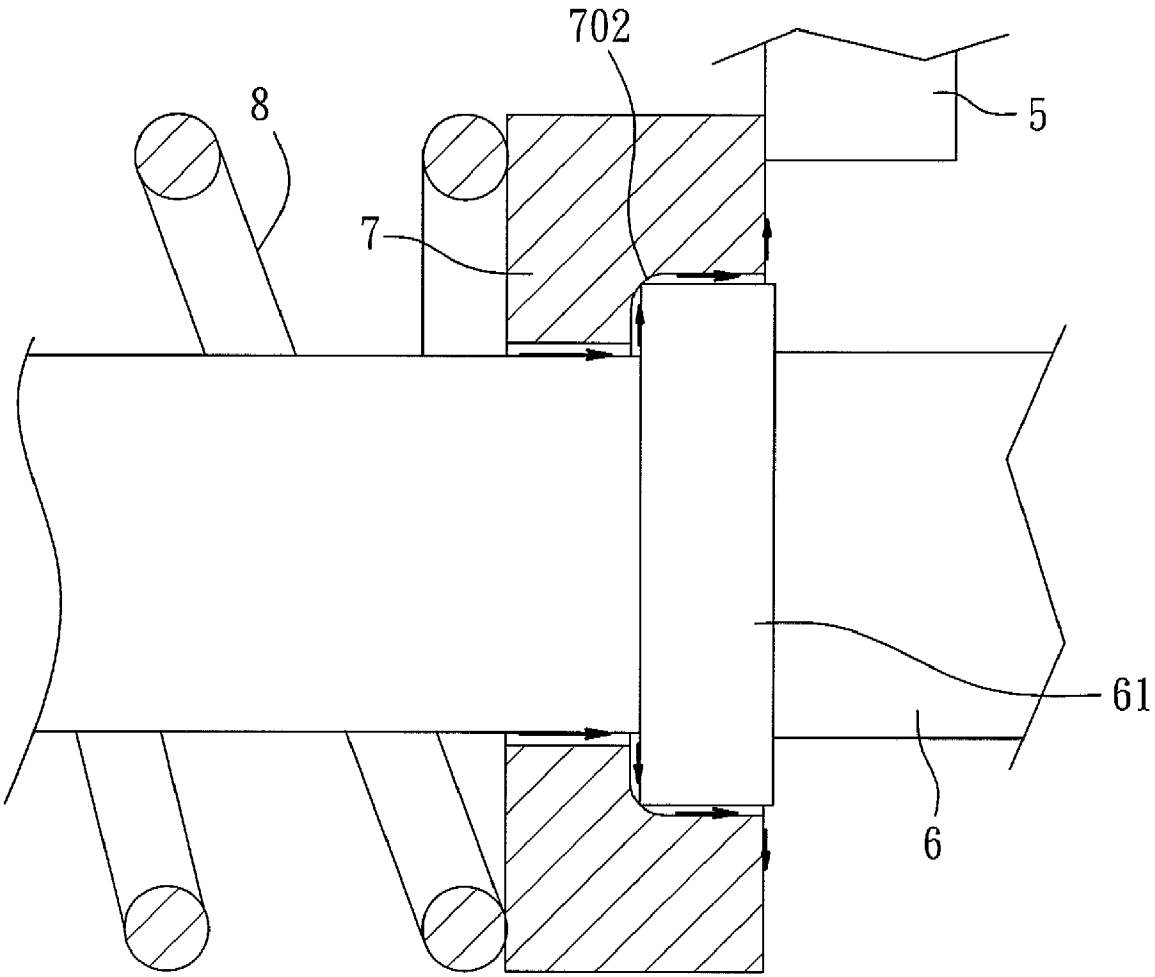
FIG. 6 is an enlarged fragmentary, schematic partly sectional view illustrating a signal transmission path of the preferred embodiment when in the first state of use.

In use, the electrical connector of this invention can be operated in one of a first state, where the conductive ring 7 is pushed by the biasing member 8 to move toward the annular flange 61 of the second terminal 6 such that the annular flange 61 of the second terminal 6 contacts electrically the inner annular abutting face 702 of the conductive ring 7 and that the second ring section 72 of the conductive ring 7 contacts electrically the first terminal 5, as shown in FIG. 3, and where an external signal, such as a high-frequency signal, inputted to the male end portion 62 of the second terminal 6 is adapted to be transmitted to the first terminal 5 via the second terminal 6 and the conductive ring 7, as indicated by arrows in FIG. 6, and a second state, where the conductive ring 7 is pushed by the actuating sleeve 9 as a result of insertion of the external terminal 200 into the housing 3 to move toward the first open end 32 of the housing 3 such that the conductive ring 7 is pushed by the actuating sleeve 9 to move away from the first terminal 5, as shown in FIG. 4, and where an external signal inputted to the male end portion 62 of the second terminal 6 is transmitted to the external terminal 200 via the second terminal.

In such a configuration, it is noted that, when the electrical connector is switched from the second state to the first state, i.e., when the external terminal 200 is removed from the housing 3, the conductive ring 7 is pushed as a result of a restoration force of the biasing member 8 to move toward the annular flange 61 such that the inner annular abutting face 702 of the conductive ring 7 first contacts electrically the annular flange 61, as indicated by imaginary lines in FIG. 5. Subsequently, due to guiding of the inner annular abutting face 702 of the conductive ring 7, the conductive ring 61 further moves upwardly toward the second open end 33 of the housing 3 so as to contact electrically the first terminal 5, thereby ensuring electrical connection between the first and second terminals 5, 6 when the electrical connector is operated in the first state. Moreover, during transition from the second state to the first state, the conductive ring 7 evenly and smoothly slides on the second terminal 6 until the inner annular abutting face 702 of the conductive ring 7 abuts against the annular flange 61, thereby avoiding formation of scratches on the second terminal 6. Therefore, the electrical connector of this invention has superior electrical signal transmission characteristics.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An electrical connector comprising:

a tubular housing having first and second open ends opposite to each other in an axial direction and formed with a through hole;

an insulating first terminal-mounting seat mounted fixedly in said through hole in said housing;

a first terminal fixed to said first terminal-mounting seat and extending in a radial direction through said first terminal-mounting seat and into said housing;

an insulating second terminal-mounting seat disposed fixedly in said housing and disposed adjacent to said first open end of said housing;

a second terminal disposed in said housing, fixed to said second terminal-mounting seat, and extending in the axial direction through said second terminal-mounting seat, said second terminal having a radially and outwardly extending annular flange that is spaced apart from said second terminal-mounting seat and that is disposed adjacent to said first terminal;

a conductive ring sleeved movably on said second terminal, and having a first ring section disposed between said second terminal-mounting seat and said annular flange of said second terminal and having an inner diameter smaller than an outer diameter of said annular flange of said second terminal, and a second ring section connected integrally to said first ring section and having an inner diameter slightly larger than the outer diameter of said annular flange of said second terminal, said conductive ring having a curved inner annular abutting face disposed at a junction of said first and second ring sections;

a biasing member disposed between said second terminal-mounting seat and said conductive ring for biasing said conductive ring to move toward said annular flange of said second terminal such that said annular flange comes into electrical contact with said inner annular abutting face of said conductive ring and that said second ring section of said conductive ring contacts electrically said first terminal; and an actuating sleeve sleeved movably on said second terminal, disposed between said conductive ring and said second open end of said housing, and operable so as to move toward said first open end of said housing such that said conductive ring is pushed by said actuating sleeve to move away from said first terminal.

2. The electrical connector as claimed in claim 1, wherein said actuating sleeve has a first sleeve portion disposed adjacent to said second open end of said housing and sleeved movably on said second terminal, and a second sleeve portion connected integrally to said first sleeve portion and extending toward said conductive ring, said second sleeve portion of said actuating sleeve being coaxial with said annular flange of said second terminal, having an inner diameter larger than the outer diameter of said annular flange of said second terminal, and coming into electrical contact with said second ring section of said conductive ring when said actuating sleeve moves toward said first open end of said housing.

3. The electrical connector as claimed in claim 1, wherein said biasing member is sleeved on said second terminal.

4. The electrical connector as claimed in claim 3, wherein said biasing member is a coil spring that has opposite ends abutting respectively against said second terminal-mounting seat and said first ring section of said conductive ring.

* * * * *